US007891194B2

(12) United States Patent
Biebel et al.

(10) Patent No.: US 7,891,194 B2
(45) Date of Patent: Feb. 22, 2011

(54) CONFIGURATION OF DILUTION OPENINGS IN A TURBOMACHINE COMBUSTION CHAMBER WALL

(75) Inventors: Romain Biebel, Le Coudray Montceau (FR); Luc Henri Claude Daguenet, Corbeil Essonnes (FR); Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 1001 days.

(21) Appl. No.: 11/691,835

(22) Filed: Mar. 27, 2007

(65) Prior Publication Data

US 2007/0227149 A1 Oct. 4, 2007

(30) Foreign Application Priority Data

Mar. 30, 2006 (FR) ..... 06 02744

(51) Int. Cl.
*F02C 1/00* (2006.01)
*F02G 3/00* (2006.01)

(52) U.S. Cl. ..... 60/754; 60/752

(58) Field of Classification Search ..... 60/752–760
See application file for complete search history.

(56) References Cited

U.S. PATENT DOCUMENTS 2,625,792 A * 1/1953 McCarthy et al. ..... 60/757
2,638,745 A * 5/1953 Nathan ..... 60/748
3,019,605 A * 2/1962 Murray ..... 60/759
3,134,229 A * 5/1964 Johnson ..... 60/748
4,244,178 A * 1/1981 Herman et al. ..... 60/754
4,301,657 A * 11/1981 Penny ..... 60/748
4,527,397 A * 7/1985 Tobery et al. ..... 60/757
4,887,432 A * 12/1989 Mumford et al. ..... 60/759
4,944,152 A * 7/1990 Shekleton ..... 60/804
5,150,570 A * 9/1992 Shekleton ..... 60/804
5,167,122 A * 12/1992 Shekleton ..... 60/743
5,172,546 A * 12/1992 Shekleton et al. ..... 60/804
5,174,108 A * 12/1992 Shekleton ..... 60/804
5,205,117 A * 4/1993 Shekleton et al. ..... 60/778
5,220,794 A * 6/1993 Sledd et al. ..... 60/737
5,241,818 A * 9/1993 Shekleton et al. ..... 60/804

(Continued)

FOREIGN PATENT DOCUMENTS

BE 488448 4/1949

(Continued)

*Primary Examiner*—William H Rodríguez
(74) *Attorney, Agent, or Firm*—Oblon, Spivak, McClelland, Maier & Neustadt, L.L.P.

(57) ABSTRACT

An annular combustion chamber of a turbomachine is provided. The combustion chamber includes an end wall provided at an upstream end of the chamber and side walls extending longitudinally from the end wall to an orifice for discharging a stream of combustion gases provided at a downstream end of the chamber. The side walls includes at least one row of openings for the intake of air for diluting the stream of combustion gases. At least one dilution opening has an upstream edge which projects toward the inside of the chamber and a downstream edge which projects toward the outside of the chamber and is asymmetric to the upstream edge with respect to a plane extending transversely to the wall. An aperture of the opening having an axis oriented in an oblique direction with respect to the wall. This direction being oriented toward the inside and toward the downstream end of the chamber.

22 Claims, 7 Drawing Sheets

U.S. PATENT DOCUMENTS

| | | | | | |
|---|---|---|---|---|---|
| 5,261,224 | A * | 11/1993 | Shekleton et al. | 60/804 |
| 5,263,316 | A * | 11/1993 | Shekleton | 60/804 |
| 5,277,021 | A * | 1/1994 | Shekleton | 60/804 |
| 5,277,022 | A * | 1/1994 | Shekleton et al. | 60/804 |
| 5,317,864 | A * | 6/1994 | Shorb et al. | 60/804 |
| 5,363,644 | A * | 11/1994 | Shekleton et al. | 60/804 |
| 5,488,829 | A * | 2/1996 | Southall et al. | 60/725 |
| 5,727,378 | A | 3/1998 | Seymour | |
| 6,351,949 | B1 * | 3/2002 | Rice et al. | 60/752 |
| 6,494,044 | B1 * | 12/2002 | Bland | 60/772 |
| 6,681,578 | B1 * | 1/2004 | Bunker | 60/772 |
| 6,931,862 | B2 * | 8/2005 | Harris | 60/804 |
| 2009/0145099 | A1 * | 6/2009 | Jennings et al. | 60/39.37 |

FOREIGN PATENT DOCUMENTS

| | | | |
|---|---|---|---|
| EP | 0 743 490 | A1 | 11/1996 |
| FR | 1.052.475 | | 1/1954 |
| FR | 2.081.220 | | 12/1971 |

* cited by examiner

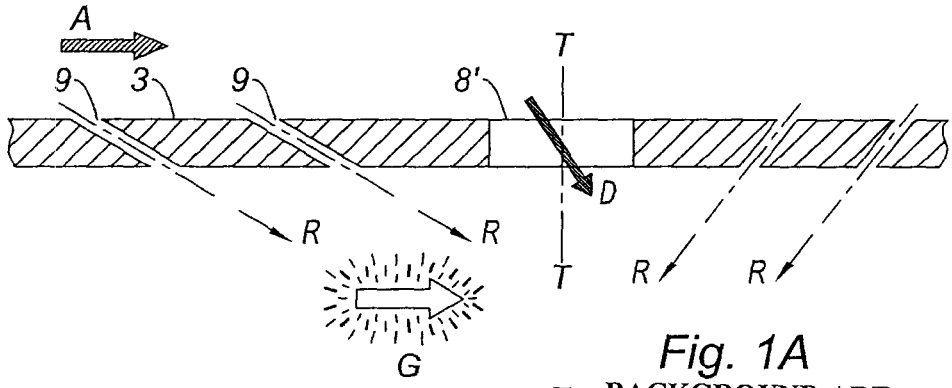
Fig. 1A
BACKGROUND ART
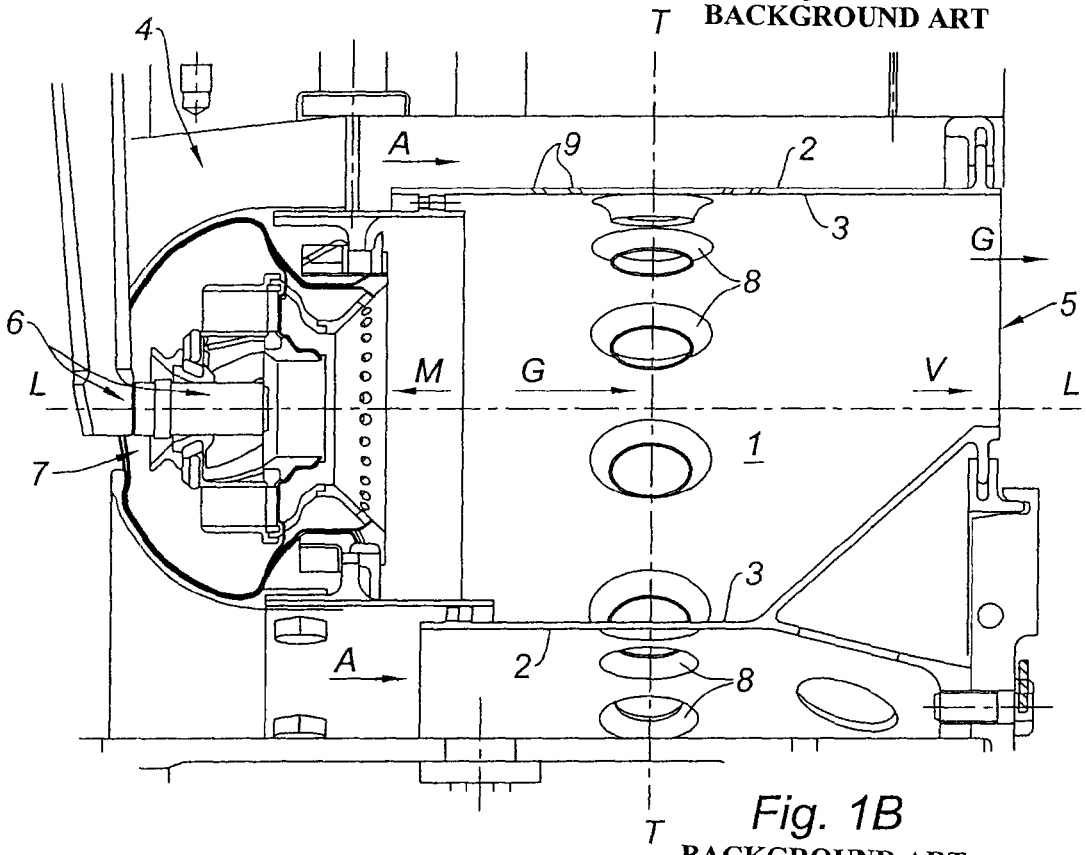
Fig. 1B
BACKGROUND ART
Fig. 1C
BACKGROUND ART
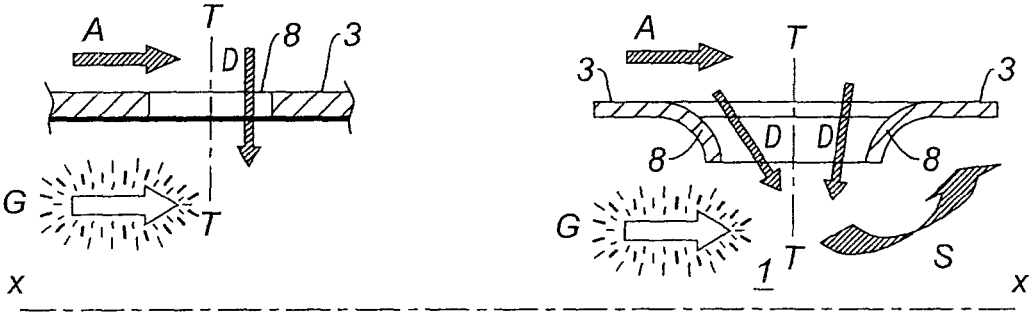
Fig. 1D
BACKGROUND ART

7A

7B

CONFIGURATION OF DILUTION OPENINGS IN A TURBOMACHINE COMBUSTION CHAMBER WALL

1—TECHNICAL FIELD AND BACKGROUND OF THE INVENTION

The invention relates to the field of combustion chambers of turbine engines and, more specifically, to the configuration of the dilution air intake openings and the cooling air passage perforations formed in the walls of the flame tube or in any combustion chamber wall element.

FIG. 1B shows a view in axial section of a turbomachine combustion chamber 1 according to the prior art, as described in patent document EP-A-0 743 490 in the name of the applicant.

The combustion chamber 1 is formed by two concentric tubular side walls 3, constituting a flame tube (extending in the longitudinal direction L-L of the chamber, parallel here to the axis X-X of the turbomachine). The chamber is closed at one end, the upstream end M, by an annular end wall 4 at which are located fuel injectors 6 and oxidizer air inlets 7, the combustion of the fuel and oxidizer generating a stream of combustion gases. The chamber is terminated at the other end, the downstream end V, by an annular orifice 5 for expelling the stream G of burnt gases destined for the rotating gas turbine of the turbomachine.

As illustrated in FIG. 1B, dilution openings 8 or holes are formed in the side walls 3 of the chamber 1 so that an additional stream A of fresh air can be mixed into the stream G of combustion gases which propagates toward the downstream end V of the chamber 1. This additional fresh air A serves to dilute the burning gases G, to reduce their temperature, to cool the walls and to increase the proportion of air in the gas mixture. This is done in an attempt to optimize the stoichiometry of the oxidizer air/fuel mixture, to burn the unburnt residues and to reduce emissions of $NO_x$—nitrogen oxides—, with the aim of improving the combustion of the gas mixture G (especially by prolonging, over the entire extent of the chamber, the combustion of the initially too rich mixture upon ignition).

The dilution air intake openings 8 pierced in the side walls 3 are arranged along the circumference of the tubular walls at a central axial position between the end wall M and the orifice 5 of the chamber 1.

Various techniques are known in the prior art for forming the dilution openings 8.

As illustrated in views 1A and 1C, there are dilution openings 8' known as "square-edge holes". The opening 8' is obtained by simple normal piercing (with a drill or by cutting with a punch) of a cylindrical bore with straight edges perpendicular to the wall 3 of the chamber 1. The opening 8' can also be produced by laser.

These dilution openings 8' with straight edges according to the prior art have the disadvantages of not allowing good intake of the dilution air stream D and of not providing good efficiency. The compressed fresh air stream A which flows in the bypass duct 2 around the combustion chamber 1 and which sweeps along the side walls 3 of the chamber is suddenly deviated at a right angle D to pass along the axis T-T of the opening 8'.

There is another known technique for producing dilution openings 8, as illustrated in views 1B and 1D, in which the openings 8 have "bent-over edges", that is to say edges folded toward the inside of the chamber 1 and observing a certain degree of curvature (edges having "radiused" or rounded regions), giving them a crater shape.

These dilution openings 8 with "bent-over edges" have the disadvantages of being exposed to the incidence of the stream of burning gases G, thus causing the appearance of hot spots and sometimes burn regions on the crest of the "crater" formed by the edge of the opening 8, and especially in the wake region downstream of the opening, because of the vortex S caused by the incidence of the longitudinal stream of burning gas G on the crest of the edge 8 which projects transversely with respect to the inside of the chamber 1.

Moreover, beside the dilution openings 8' (commonly known as dilution holes/apertures), which have relatively large dimensions, the walls 3 of the chamber 1 comprise perforations 9 having tiny dimensions. These microperforations are distributed over the entirety of these metal walls 3, preferably being concentrated in the vicinity of the dilution openings 8'. These perforations (commonly known as impingement holes) serve for the injection of microstreams of air whose primary function is to cool the metal mass of the side walls 3 to enable them to withstand the very high temperatures (more than 1000° C.) of the burning gases G in the combustion chamber 1. A distinction should be drawn here between these microperforations for injecting cooling air, referred to here as cooling perforations, and the relatively large dilution air intake openings, referred to here as dilution openings.

Another disadvantage of the dilution openings 8' with "bent-over edges" is that the curvature of the folded edges does not allow cooling perforations to be pierced in the immediate vicinity of the opening 8 and specifically in the regions exposed to the formation of hot spots or burns, which would require effective cooling. The deformation of the edges of the dilution opening prevents the perforations from being brought up close to the edges without adversely affecting them.

The aim of the invention is to overcome the disadvantages of the current solutions and to produce a combustion chamber provided with dilution openings for optimizing the intake of the air stream while as far as possible preventing turbulence and the formation of hot spots that are detrimental to the thermomechanical integrity of the combustion chamber and to its service life.

2—SUMMARY OF THE INVENTION

To achieve this aim, the invention relates to an annular combustion chamber of a turbomachine having an end wall extending transversely to a longitudinal axis along which the chamber extends, and side walls extending longitudinally from the end wall, situated at the upstream end of the chamber, to an orifice for discharging a stream of combustion gases, situated at the downstream end of the chamber, the side walls comprising at least one row of openings for the intake of air for diluting the stream of combustion gases, with the distinguishing feature that at least one dilution opening has an upstream edge which projects toward the inside of the chamber and a downstream edge which is asymmetric to the upstream edge with respect to a plane extending transversely to the wall, the aperture of the opening having an axis oriented in an oblique direction with respect to the wall, this direction being oriented toward the inside and toward the downstream end of the chamber.

According to one embodiment, the downstream edge projects toward the outside of the chamber.

Preferably, the downstream edge projects less than the upstream edge.

According to another embodiment, the downstream edge is substantially rectilinear.

According to one advantageous feature, the upstream edge is folded in an oblique direction with respect to the side wall and oriented toward the inside and toward the downstream end of the chamber.

According to another advantageous feature, the downstream edge is folded in an oblique direction with respect to the side wall and oriented toward the outside and toward the upstream end of the chamber.

The bore of the opening may have substantially cylindrical walls.

Generally, the opening has an elliptical cross section at the surface of the side wall.

In particular, the elliptical cross section of the opening may have a major axis directed in a longitudinal direction of the chamber going from the upstream end toward the downstream end.

Alternatively, the major axis of the ellipse of the opening may be directed substantially transversely.

Advantageously, the projecting edge of the opening extends and smooths out transversely and/or the protrusion of the upstream projecting edge decreases progressively from the upstream end toward the downstream end.

Preferably, at least one projecting edge has an arch shape.

In particular, the upstream edge forms an arch projecting toward the inside and toward the downstream end of the chamber and/or the downstream edge forms an arch projecting toward the outside and toward the upstream end of the chamber.

Advantageously, the arch or arches of the opening is or are elongated transversely.

Furthermore, provision is made according to the invention for the side wall to comprise a plurality of perforations for the passage of cooling air.

Advantageously, cooling perforations are formed on at least one edge and/or in a region around the edge of the dilution opening.

In particular, cooling perforations may be formed around the downstream periphery of the dilution opening.

Provision is advantageously made for the periphery of the opening to have a density of cooling perforations greater than the remainder of the side wall of the chamber.

Preferably, the cooling perforations are directed obliquely with respect to the surface of the side wall; in particular, the cooling perforations are oriented obliquely in the direction going from the upstream end toward the downstream end when following the passage of air from the outside toward the inside of the chamber.

The invention applies to a turbomachine provided with such a combustion chamber.

The invention also relates to a side wall element for forming such a combustion chamber, the wall element comprising at least one dilution opening having an upstream edge which projects toward the inner side of the wall and a downstream edge which is asymmetric to the upstream edge with respect to a plane extending transversely to the wall, the aperture of the opening having an oblique axis with respect to the wall, this axis being oriented toward the inside and toward the downstream end.

The invention can also relate to a side wall element of a turbomachine combustion chamber having a gas combustion region situated upstream and a combustion gas discharge orifice situated downstream, the side wall comprising openings for the intake of air for diluting the stream of combustion gases, the wall element comprising at least one dilution opening having an upstream edge which projects toward the inner side of the wall and a downstream edge which is asymmetric to the upstream edge with respect to a plane extending transversely to the wall, the aperture of the opening having an oblique axis with respect to the wall, this axis being oriented toward the inside and toward the downstream end.

3—KEY TO THE FIGURES

Other distinguishing features or advantages of the invention will become clearly apparent from the remainder of the description given by way of nonlimiting example and with reference to the appended figures, in which:

FIG. 1B, described above, shows a turbomachine combustion chamber, viewed in axial section along the axis of the turbomachine, accompanied by detailed sectional views 1A, 1C and 1D showing various configurations of dilution air intake openings with symmetrical edges according to the prior art;

4—DETAILED DESCRIPTION

Figure 2:
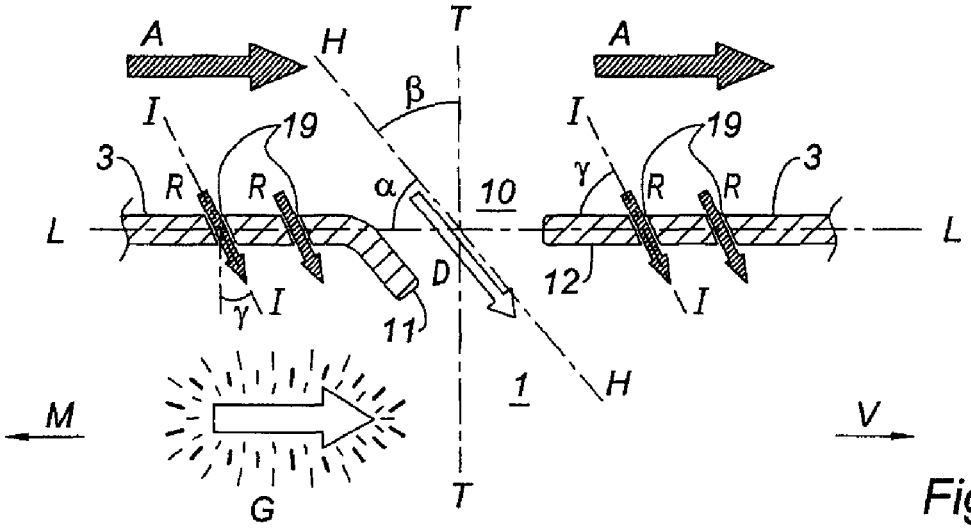
FIG. 2 is a schematic view in longitudinal section of a first embodiment of a dilution opening provided with asymmetric edges (projecting upstream edge, square downstream edge) according to the invention.
Figure 3:
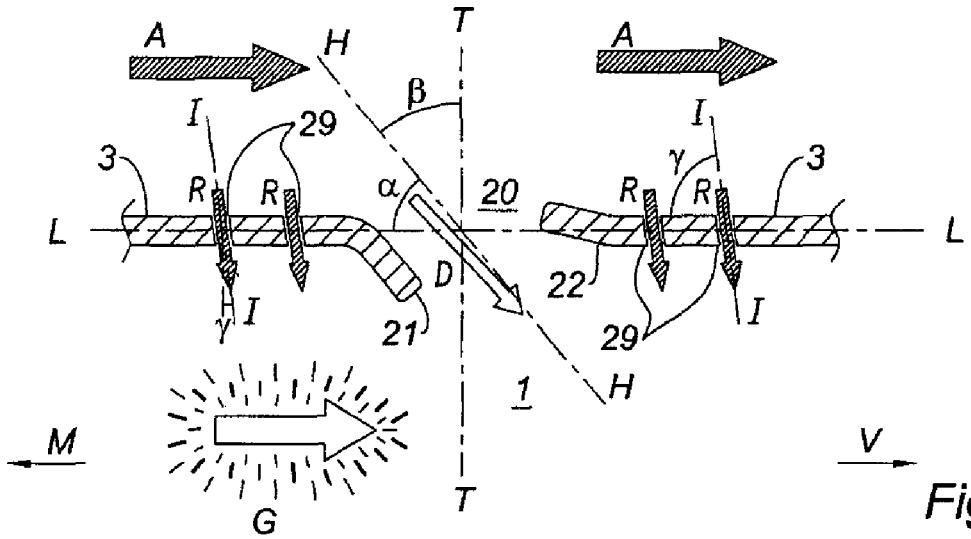
FIG. 3 is a schematic sectional view of a second embodiment of a dilution opening with an upstream edge projecting strongly toward the inside and a downstream edge projecting gently toward the outside, according to the invention.
Figure 4:
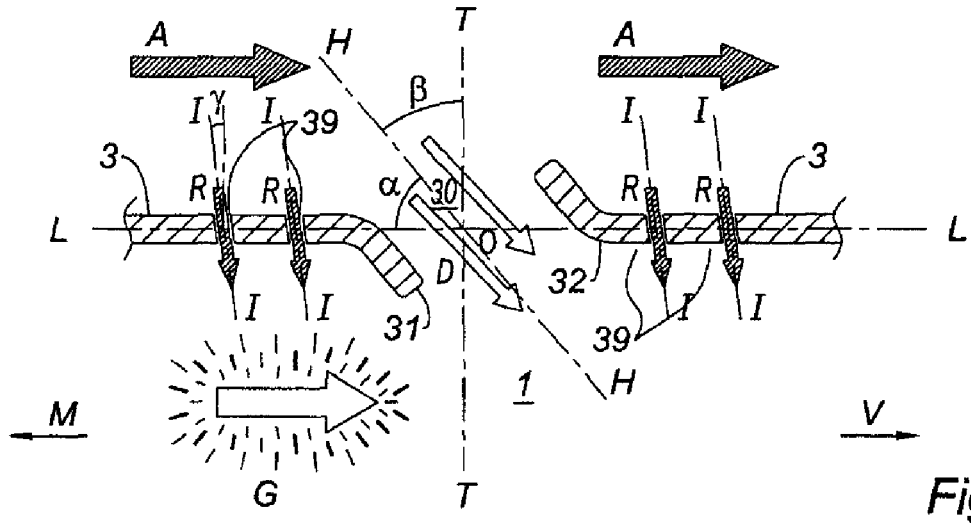
FIG. 4 is a schematic sectional view of a third embodiment of a dilution opening with an upstream edge projecting toward the inside and a downstream edge likewise projecting, but toward the outside, according to the invention.

The diagrams of FIGS. 2, 3 and 4 represent three embodiments of dilution air intake openings 10, 20, 30 in a side wall element 3 of a combustion chamber 1 according to the invention, these three embodiment figures showing that the dilution opening comprises asymmetric edges 11/12, 21/22 and 31/32. More precisely, unlike the prior art, the upstream edge 11/21/31 and downstream edge 12/22/32 of the opening are not symmetrical with respect to a plane T-T extending transversely to the side wall 3.

The combustion chamber side walls are formed from metal materials, particularly alloys of refractory metals which can withstand creep and oxidation at the very high temperatures (particularly above 1000° C.) prevailing inside a combustion chamber. By way of example, the wall elements depicted here can be produced from laminated and stamped metal sheets of nickel-based alloy, in particular an alloy of nickel, chromium and iron in which nickel is the major component, such as Hastelloy X, or of a cobalt-based alloy, in particular one combining cobalt, chromium, nickel and tungsten in which cobalt is the major component, such as HA 188.

Generally, the dilution openings 10, 20, 30 produced in a chamber wall 3 according to the invention comprise an upstream edge 11, 21 or 31 projecting toward an inner side of the chamber 1 and a downstream edge 12, 22 or 32 which does not protrude toward the inside of the chamber 1. The projection of the upstream edge 11, 21, 31 is preferably directed obliquely H-H with respect to the wall 3, the upstream edge 11, 21, 31 being folded in an oblique direction H-H oriented toward the inside 1 and toward the downstream end V of the chamber, the direction H-H being substantially inscribed in the longitudinal plane L-L of the chamber 1.

The shape of the downstream edge 12, 22, 32 of the opening 10, 20, 30 can be open to many variant embodiments, as illustrated in the figures.

According to the first embodiment schematically represented in FIG. 2, the downstream periphery 12 of the opening 10 has a square edge, that is to say a nonprojecting straight edge 12, inscribed in the continuation of the side wall 3 (planar or rectilinear edge).

According to the second embodiment schematically represented in FIG. 3, the opening 20 has a downstream edge 22 projecting slightly toward the outside of the chamber 1, the downstream edge 22 (turned toward the outside) projecting less than the upstream edge 21 (turned toward the inside).

According to the third embodiment schematically represented in FIG. 4, the opening 30 has a downstream edge 32 projecting toward the outside of the chamber 1, the downstream edge 32 here projecting substantially to the same extent toward the outside as the upstream edge 31 is projecting toward the inside 1. In this case, the edges 31 and 32 of the opening can be symmetrical with respect to a central point O of the opening 30 without nevertheless being symmetrical with respect to a plane T-T extending transversely to the wall 3.

One advantage of an opening according to the invention having a downstream edge 22 or 32 projecting toward the outside is that of being able to capture and divert the stream A of fresh air which sweeps along the outside of the walls 3 of the chamber 1 and thus to accentuate the fresh air intake stream D into the chamber 1. Depending on how much the downstream edge 22 or 32 protrudes toward the outside, this accentuation will be marked to a greater or lesser degree.

According to another alternative embodiment (not shown), the downstream edge may, however, project slightly toward the inside of the chamber, the downstream edge projecting less toward the inside than the upstream edge. Because the downstream edge projects less than the upstream edge, it no longer forms a prominent crest inside the chamber and is no longer exposed to the incidence of the stream of burning gases.

During operation, the opening of the wall thus has an upstream edge directed obliquely in the direction of the stream of burning gases. The upstream edge is folded and protrudes to a reduced degree inside the chamber than a hole with a "bent-over edge" of the prior art. Instead of coming up against a "bent-over edge" under normal incidence (as in the prior art), the gas stream arrives with an oblique incidence against the upstream edge of the dilution opening according to the invention.

This lessens the exposure of the edge of the opening to the stream of burning gases and, therefore, reduces its temperature rise.

Furthermore, the oblique orientation of the upstream edge projecting inside the chamber limits the turbulence of the burning gas stream in the wake downstream of the opening.

This effect is reinforced by the fact that the downstream edge does not project symmetrically to the upstream edge inside the chamber, thereby inhibiting the formation of a vortex on the upstream and downstream edges of the opening.

Generally, because the downstream edge 12, 22 or 32 is not pronounced with respect to the projection of the upstream edge 11, 21 or 31, the advantage of the opening 10, 20, 30 according to the invention is that of reducing the possibility of the formation of turbulence on the downstream edge 12, 22, 32 and of inhibiting the appearance of hot spots in the wake of the opening.

The direction H-H of the opening is advantageously directed obliquely toward the inside 1 and toward the downstream end V of the chamber 1, thereby making it possible to obtain a dilution air intake stream D directed toward the inside and toward the downstream end. This offers a dual advantage:

- the fresh air stream A which sweeps along the outside of the walls 3 of the chamber 1 is diverted relatively little (with respect to a normal intake) and diverges slightly by an angle $\alpha$ to form the intake stream D. The fresh air A surges easily into the opening 10, 20, 30 to enter as D into the chamber 1;
- there is a convergence of the dilution air stream D taken into the chamber 1 with the combustion gas stream G which propagates longitudinally L-L in the chamber 1, this reducing the appearance of turbulence and optimizing the mixing of the fresh air stream D and the burning gas stream G.

Another advantage of the invention is to enable microperforations 19, 29, 39 for injecting a stream R of cooling air to be installed in the region in the immediate proximity of the edge of the opening 10, 20, 30. In particular, such perforations 19 can be pierced in the downstream edge as close as possible to the dilution opening 10. This allows effective cooling of the region or regions which were most exposed to the formation of hot spots or even burns. Increasing the effectiveness of the cooling R of the walls may make it possible to increase the service life of the combustion chamber 1 and reduce its maintenance frequency.

Figure 5:
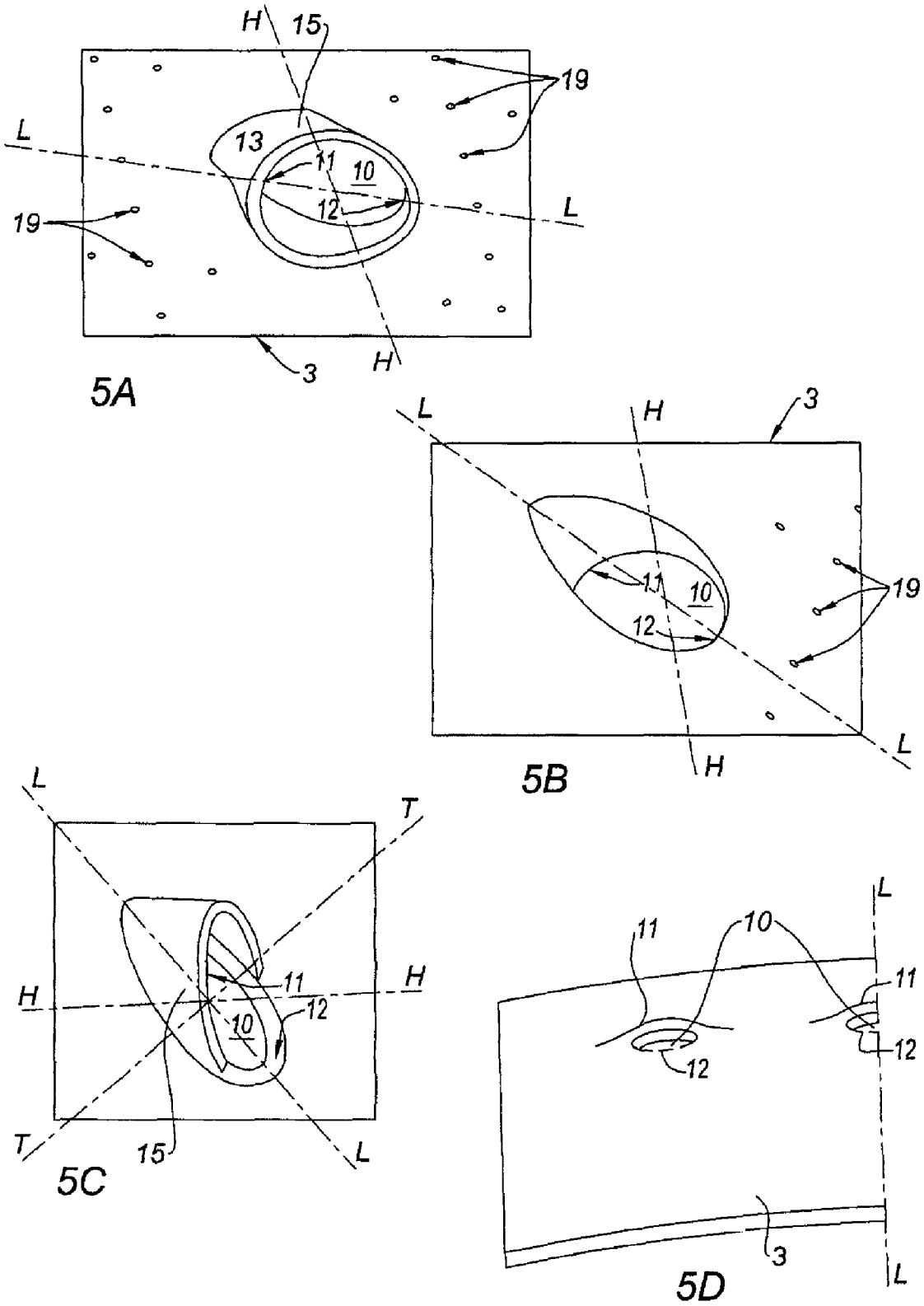
FIG. 5 shows, from various angles of view, an example of the shape of the dilution opening according to the first embodiment of the invention (inside view 5A, outside view 5B, profile view 5C and shallow-angle view 5D)

The views of FIG. 5 illustrate from various angles of view the shape of a dilution opening 10 formed according to the first embodiment of the invention, in which the dilution opening 10 comprises an upstream edge 11 projecting toward the inside of the chamber, while the downstream edge 12 does not project either toward the inside or toward the outside of the chamber.

From an inner point of view 5A of the chamber, the opening 10 has a projecting upstream edge and a straight or retreating downstream edge, that is to say that the wall 12 downstream from the opening 10 is flat as far as the edge of the latter. The wall at the downstream edge 12 of the opening is preferably planar or, more generally, rectilinear. From an outer point of view 5B, the opening 10 has a re-entrant upstream edge 11 and a square or smooth downstream edge 12.

Thus, the downstream edge 12 is substantially nonprominent with respect to the adjacent regions of the wall 3 which immediately surround it and, generally, it is less prominent than the crest of the upstream edge 11.

The upstream edge 11 of the opening 10 projects toward the inside of the chamber and forms a folded or curved wall portion on the inner side of the wall 3. Preferably, the wall portion of the upstream edge 12 is folded in an oblique direction H-H with respect to the surface of the wall 3 of the chamber. The folded wall portion of the upstream edge 12 preferably extends obliquely at an acute angle ($\alpha$ less than 90°) oriented toward the inside and toward the downstream end of the chamber.

The dilution opening 10 has an upstream edge 11 in the form of an arch 13 or a dormer window 13 of the "rounded cheek" type, that is to say in the form of a curved-arc vault 13 whose lateral edges 15 are smoothed out progressively until they merge in the plane of the wall 3. The arched vault 13 formed by the upstream edge 11 bears on generatrices H-H which are oblique with respect to the wall 3 and oriented toward the inside and toward the downstream end of the chamber. The aperture of the opening 10 is oriented obliquely toward the inside and toward the downstream end with respect to the wall 3 of the chamber. The downstream edge 12 of the opening 10, that is to say approximately half the circumference on the downstream side of the opening 10, does not have any protrusion either on the inner side or on the outer side.

Advantageously, such a shape of dilution opening 10 makes it possible for microperforations 19 for the passage of cooling air to be installed around the opening 10 and right up to the edge 12 of the opening 10. In particular, the cooling perforations 19 (commonly known as impingement holes) can be pierced around the immediate periphery of the downstream edge 12 which is most exposed to the formation of hot spots or burns.

It is apparent from view 5B that, given the oblique orientation of the opening, said opening can have an orifice with a transverse dimension (width) smaller than its longitudinal dimension L-L, and therefore an elliptical shape at the surface of the wall 3.

Alternatively, provision may be made for the bore of the hole of the dilution opening itself to have an elliptical cross section, in particular with a transversely directed major axis. Consequently, the orifice of the opening can have a transverse dimension which is as wide as or even wider than its longitudinal dimension at the surface of the wall 3.

This makes it possible to stagger the intake of the fresh air stream over a large width of the wall and to form a more extensive cooling wake.

Figure 6:
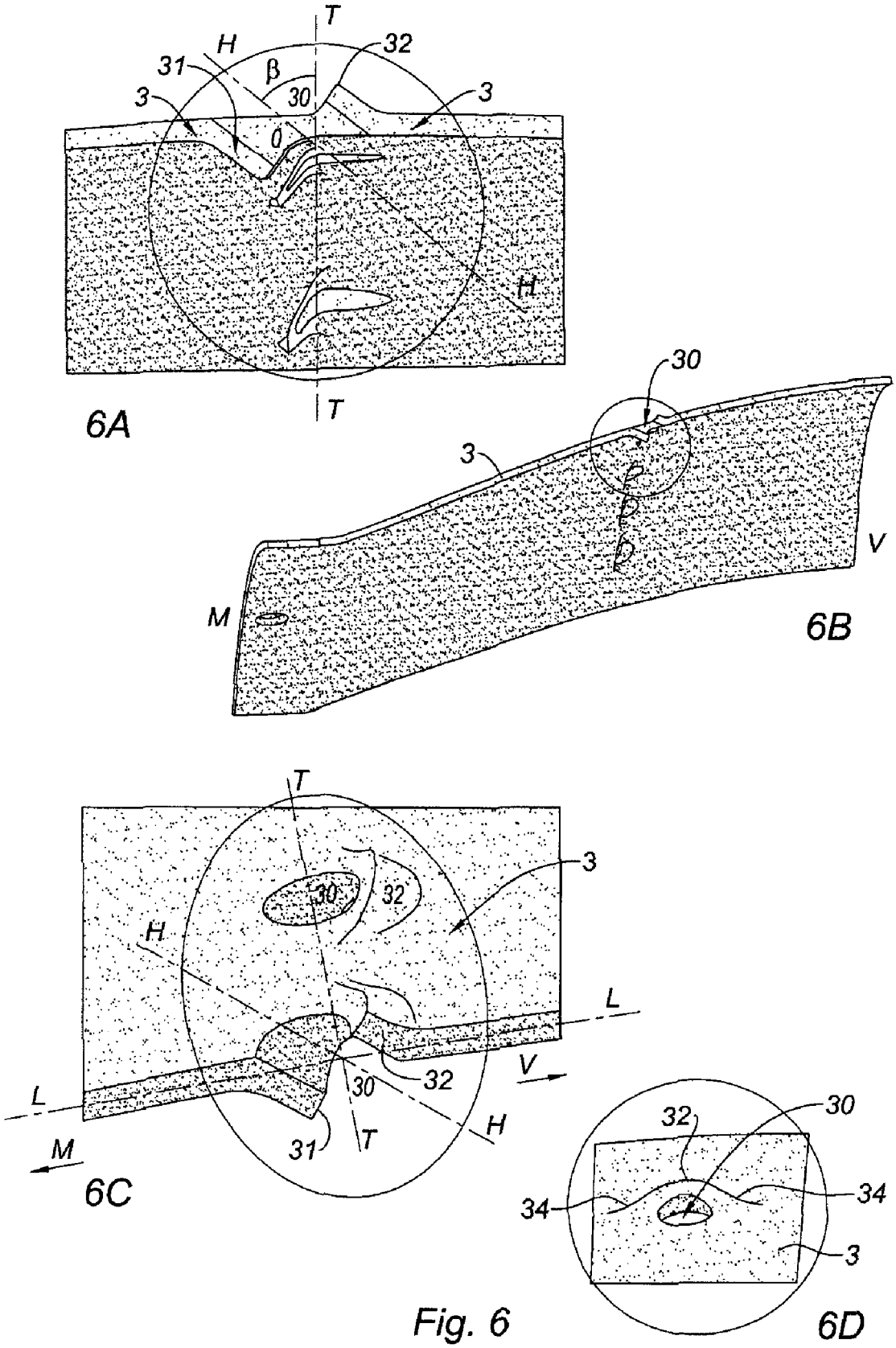
FIG. 6 shows, from various points of view, a combustion chamber wall provided with dilution openings with an upstream edge projecting toward the inside and a downstream edge projecting toward the outside, according to the third embodiment of the invention.

The views of FIG. 6 illustrate from various angles of view the shape of a dilution opening 30 formed according to the third embodiment of the invention.

The dilution opening 30 has an upstream edge 31 in the form of an arch or a dormer window of the "rounded cheek" type which is folded obliquely toward the inside 1 of the chamber, which edge is adjoined by a downstream edge 32 likewise in the form of an arch or a "dormer window with rounded cheeks", but which is folded obliquely toward the outside of the chamber 1.

As represented in view 6D, the downstream edge 32, exactly like the upstream edge 31, has a curved-arc shape whose lateral edges 34 are smoothed out progressively until they merge in the plane of the wall 3.

The inwardly oriented vault 31 formed by the upstream edge and the outwardly oriented vault 32 formed by the downstream edge can bear on generatrices parallel to the axis H-H, as illustrated in views 6A and 6C. Alternatively, the vaults can follow generatrices which are not parallel (not shown).

This results in an opening having an upstream edge 31 projecting internally 1 toward the downstream end V at the pivot angle (angle $\beta$ preferably less than 90°) and a downstream edge 32 projecting externally toward the upstream end M likewise at the pivot angle $\beta$. The opening 30 then has a center of symmetry O, although the upstream 31 and downstream 32 edges are asymmetric with respect to a transverse plane T-T perpendicular to the wall 3.

The angle $\beta$ is an acute angle. It may be around 20° to 60°, preferably between 30° and 50°, typically about 40°-45°.

Preferably, such opening shapes are obtained by die stamping.

As illustrated in views 6C and 6D, when the opening 30 is based on a cylindrical bore of circular cross section, the orifice formed at the surface of the wall 3 has an elliptical cross section whose major axis is oriented longitudinally in the direction L-L.

Figure 7:
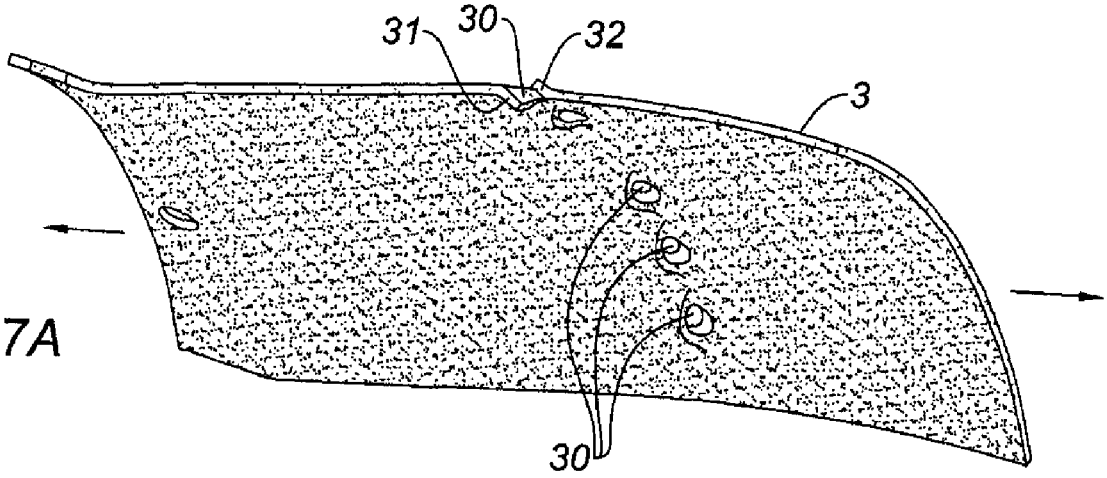
FIGS. 7A and 7B show an inside view and a shallow-angle outside view along the longitudinal axis of a combustion chamber wall provided with dilution openings with an upstream edge projecting toward the inside and a downstream edge projecting toward the outside, according to the third embodiment of the invention, the opening having the shape of a transversely extending ellipse.
Figure 7:
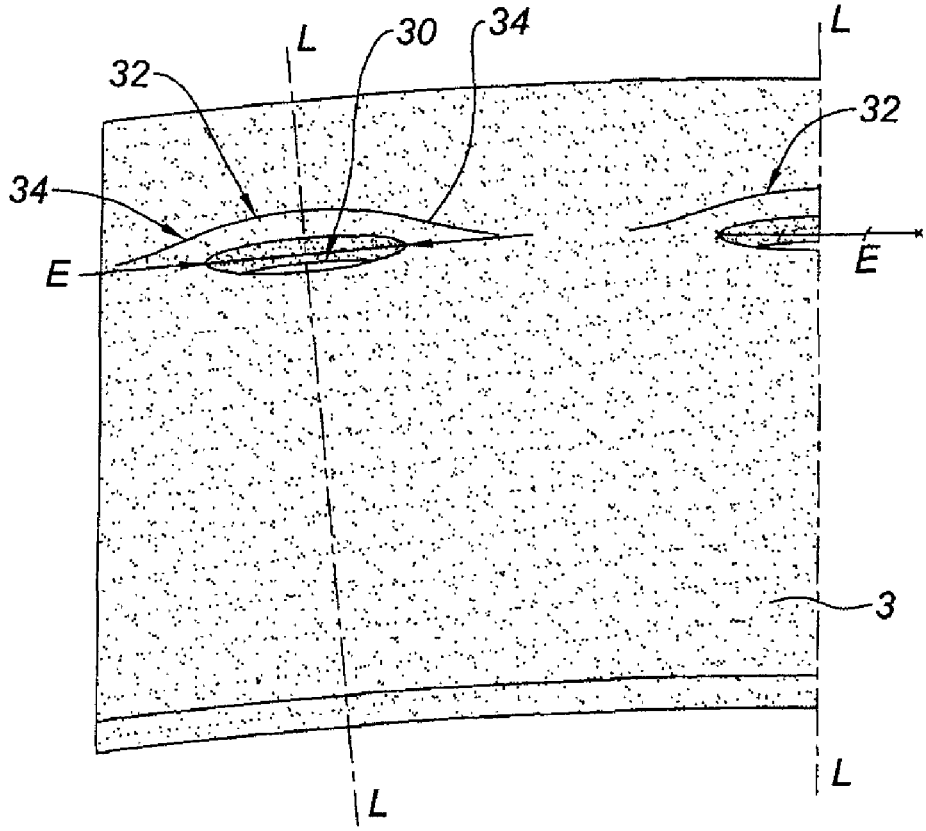
Figure 8:
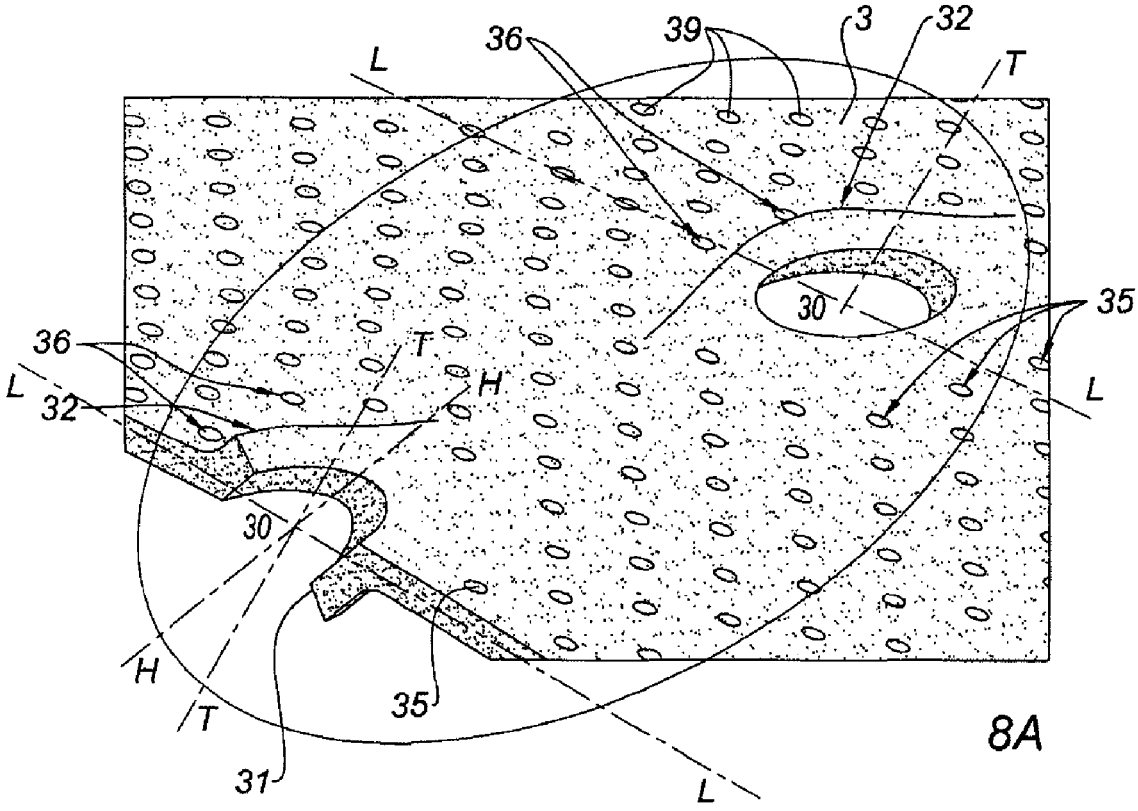
FIGS. 8B and 8A show an overall view and a detail view of the outside of a combustion chamber wall provided with a plurality of dilution air intake openings and with a multitude of cooling air injection perforations arranged around the opening, according to the invention.
Figure 8:
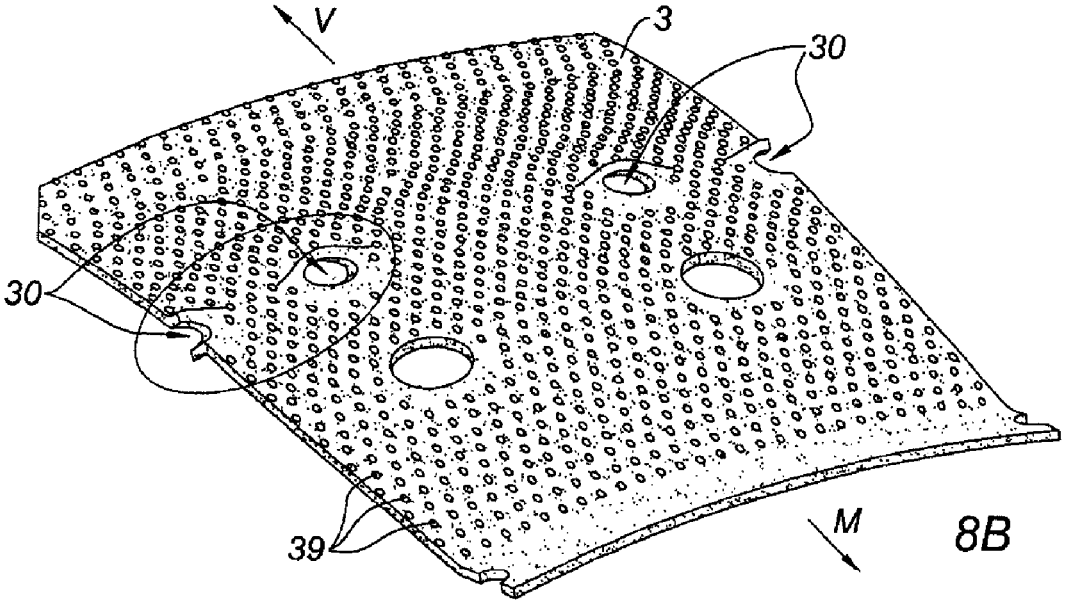
Figure 9:
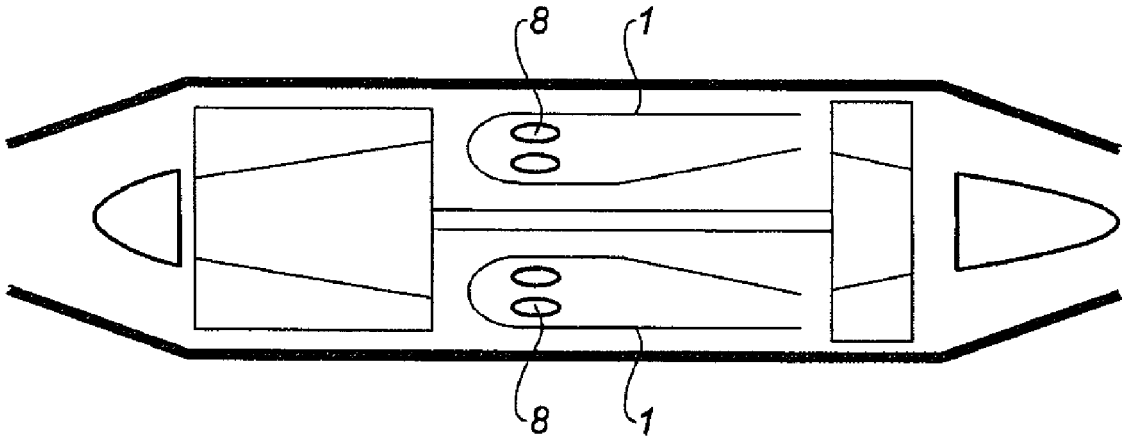
FIG. 9 shows a turbomachine comprising a combustion chamber according to the invention.

Preferably, as illustrated in the views of FIGS. 7 and 8, the bore of the hole of the opening 30 has an elliptical cross section with a major axis E arranged in the transverse direction. This makes it possible to obtain an orifice 30 having, at the surface of the wall 3, a transverse dimension E which is as wide as or even much wider than its longitudinal dimension L-L.

The vaulted arch 32 formed by the downstream edge which projects toward the outside and toward the upstream end M with respect to the chamber 1 advantageously makes it possible to capture, in the manner of a scoop or a trough, the fresh air stream A which flows outside and along the wall 3. The fresh air stream A which flows around the chamber 1 from the upstream end toward the downstream end can thus be easily diverted, and virtually without any loss of pressure (no pressure drop), toward the inside of the chamber 1, thereby facilitating its intake.

On the other side, at the outlet of the orifice, on the inner side 1 of the wall 3, the fresh air stream D taken in can sweep along the wall 3 and at the same time form a laminar flow which cools the wall 3 and advantageously isolates it from the stream G of burning gases. The fresh air stream D taken in is advantageously deflected by the vault of the upstream edge 31 and is additionally subjected to the incidence of the stream G of burning gases.

Advantageously, as illustrated in the views of FIG. 8, such a dilution opening 30 provided with an internally projecting upstream edge 31 and an externally projecting downstream edge 32 makes it possible for microperforations 39 for the injection of cooling air (commonly known as impingement holes) to be pierced right up to the edge of the dilution opening 30. Cooling perforations 35 and 36 can be pierced, in particular, right up to the periphery of the downstream edge 32 or right up to the periphery of the upstream edge 31.

The perforations 35, 36, 39 for the passage of cooling air have dimensions in the order of a millimeter or submillimeter (in particular of around a tenth of a millimeter to a few millimeters, typically ½ mm to 2 mm). The cooling perforations are preferably pierced in an oblique direction I-I oriented toward the inside 1 and toward the downstream end V of the chamber 1. As illustrated in FIGS. 2, 3, 4, the oblique angle $\gamma$ of the microperforations R may be different from or of the same order of size as the oblique angle $\beta$ of the dilution openings D.

The angle $\gamma$ of the cooling perforations may be around a few degrees to a few tens of degrees, the angle $\gamma$ generally being less than 60° with respect to the normal T-T to the wall.

The cooling perforations 19, 29, 35, 36, 39 are advantageously pierced using laser beam tooling according to the customary techniques with a laser beam of appropriate wavelength, energy and cross section. The primary function of these perforations is to make the wall air-permeable so that heat can be removed by convection.

The dilution openings 10, 20, 30 having upstream edges 11, 21, 31 in the form of an internally projecting smoothed-out arch and externally projecting downstream edges 12, 22, 32 can thus be surrounded by multiple cooling microperforations 35, 36 arranged right up to the edge of the opening 10, 20, 30 in the region which was liable to have hot spots or localized burns.

The invention applies to a turbomachine comprising a combustion chamber 1 according to the invention.

The invention claimed is:

1. An annular combustion chamber of a turbomachine comprising:

an end wall extending transversely to a longitudinal axis along which axis the chamber extends, the end wall being provided at an upstream end of the chamber;

side walls extending longitudinally from the end wall to an orifice which discharges a stream of combustion gases, the orifice being provided at a downstream end of the chamber; and at least one row of openings disposed in the side walls for the intake of air for diluting a stream of combustion gases, wherein at least one dilution opening includes an upstream edge which projects in the longitudinal direction upstream to downstream toward an inside of the chamber and a downstream edge which projects in the longitudinal direction downstream to upstream toward an outside of the chamber and is asymmetric to the upstream edge with respect to a plane extending transversely to the side wall, and wherein an aperture of the opening includes an axis oriented in an oblique direction at an angle with respect to a longitudinal plane of the side wall, the axis of the aperture of the opening extends toward the inside of the chamber and toward the downstream end of the chamber.

2. The combustion chamber as claimed in claim 1, wherein the downstream edge projects less than the upstream edge.

3. The combustion chamber as claimed in claim 1, wherein the upstream edge is folded in an oblique direction with respect to the side wall and oriented toward the inside and toward the downstream end of the chamber.

4. The combustion chamber as claimed in claim 1, wherein the downstream edge is folded in an oblique direction with respect to the side wall and oriented toward the outside and toward the upstream end of the chamber.

5. The combustion chamber as claimed in claim 1, wherein a bore of the opening includes substantially cylindrical walls.

6. The combustion chamber as claimed in claim 1, wherein the opening includes an elliptical cross section at the surface of the side wall.

7. The combustion chamber as claimed in claim 6, wherein the elliptical cross section of the opening includes a major axis directed in the longitudinal direction of the chamber from the upstream end toward the downstream end.

8. The combustion chamber as claimed in claim 6, wherein a major axis of the ellipse of the opening is directed substantially in a transverse direction.

9. The combustion chamber as claimed in claim 1, wherein the projecting edge of the opening extends and smooths out transversely.

10. The combustion chamber as claimed in claim 1, wherein the protrusion of the upstream projecting edge decreases progressively from the upstream end toward the downstream end.

11. The combustion chamber as claimed in claim 1, wherein at least one of the upstream or downstream edge has an arch shape.

12. The combustion chamber as claimed in claim 1, wherein at least one of the upstream or downstream edge forms an arch projecting toward the inside and toward the downstream end of the chamber.

13. The combustion chamber as claimed in claim 1, wherein the downstream edge forms an arch projecting toward the outside and toward the upstream end of the chamber.

14. The combustion chamber as claimed in claim 12, wherein the arch of the opening is elongated transversely.

15. The combustion chamber as claimed in claim 1, wherein the side wall comprises a plurality of perforations for the passage of cooling air.

16. The combustion chamber as claimed in claim 15, wherein the cooling perforations are provided in a region around the edge of the dilution opening.

17. The combustion chamber as claimed in claim 15, wherein cooling perforations are provided around the downstream periphery of the dilution opening.

18. The combustion chamber as claimed in claim 15, wherein the periphery of the opening has a density of cooling perforations greater than the remainder of the side wall of the chamber.

19. The combustion chamber as claimed in claim 16, wherein the cooling perforations are directed obliquely with respect to the surface of the side wall.

20. The combustion chamber as claimed in claim 19, wherein the cooling perforations are oriented obliquely in the direction going from the upstream end toward the downstream end when following the passage of air from the outside toward the inside of the chamber.

21. A turbomachine which comprises a combustion chamber as claimed in claim 1.

22. A side wall element for forming a combustion chamber as claimed in claim 1, wherein the wall element comprises at least one dilution opening having an upstream edge which projects in a longitudinal direction toward the inner side of the wall and a downstream edge which projects in the longitudinal direction toward the outside of the chamber and is asymmetric to the upstream edge with respect to a plane extending transversely to the wall, the aperture of the opening includes an oblique axis with respect to the wall which is oriented toward the inside and toward the downstream end.

* * * * *